US006083040A

United States Patent [19]

Mosquera

[11] Patent Number: 6,083,040

[45] Date of Patent: Jul. 4, 2000

[54] CONNECTOR WITH RELEASABLE MOUNTING FLANGE

[75] Inventor: Rene Augusto Mosquera, Laguna Niguel, Calif.

[73] Assignee: ITT Manufacturing Enterprises, Inc., Wilmington, Del.

[21] Appl. No.: 08/900,557

[22] Filed: Jul. 25, 1997

[51] Int. Cl.[7] ..... H01R 13/73

[52] U.S. Cl. ..... 439/548

[58] Field of Search ..... 439/332, 333, 439/546, 547, 548, 562, 563, 569, 570, 565

[56] References Cited

U.S. PATENT DOCUMENTS

| | | | |
|---|---|---|---|
| 3,398,391 | 8/1968 | Brishka | 339/94 |
| 3,430,187 | 2/1969 | De Man et al. | 339/103 |
| 3,719,918 | 3/1973 | Kerr | 339/90 |
| 3,772,637 | 11/1973 | Paullus et al. | 339/102 |
| 3,790,698 | 2/1974 | Engert | 174/152 |
| 3,803,531 | 4/1974 | Sorensen | 339/60 |
| 3,818,420 | 6/1974 | Barr | 339/90 |
| 3,930,703 | 1/1976 | Kinast | 339/14 |
| 3,982,813 | 9/1976 | Cope et al. | 439/548 |
| 4,066,314 | 1/1978 | Williams | 339/89 |
| 4,193,655 | 3/1980 | Herrmann, Jr. | 339/31 |
| 4,427,255 | 1/1984 | Cox | 439/548 |
| 5,035,646 | 7/1991 | Ehrenfels et al. | 439/536 |
| 5,759,064 | 6/1998 | Sugiyama | 439/548 |

*Primary Examiner*—Paula Bradley
*Assistant Examiner*—Truc Nguyen
*Attorney, Agent, or Firm*—Thomas L. Peterson

[57] ABSTRACT

An electrical connector is disclosed in which a mounting flange, for mounting the connector on a panel, is releasably secured to the connector body while simultaneously providing a seal between the flange and the body. The seal is preferably in the form of an O-ring which cooperates with locking pins on the flange and matching recesses on the connector body to provide a detent mechanism that permits the releasable locking of the flange onto the body.

7 Claims, 4 Drawing Sheets

FIG. 2A
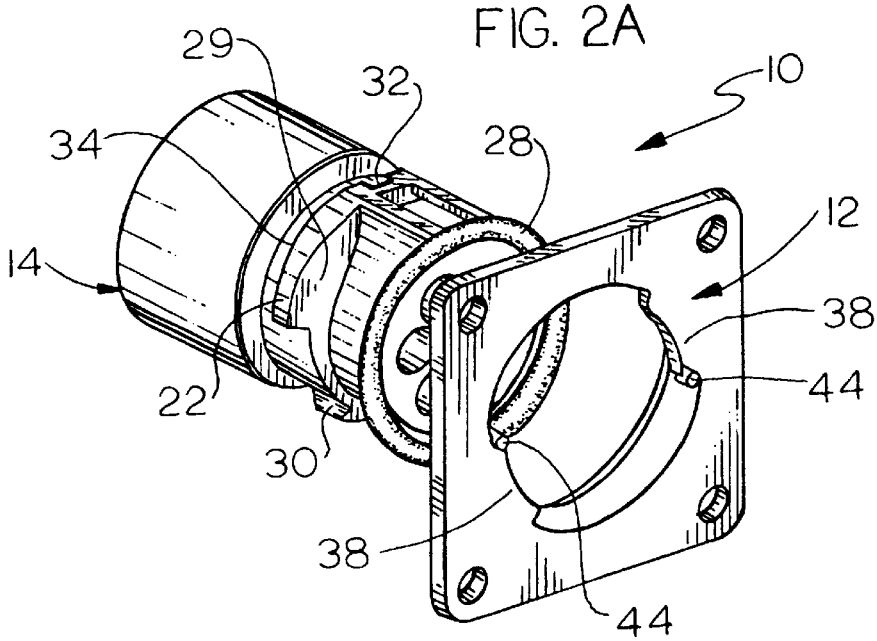
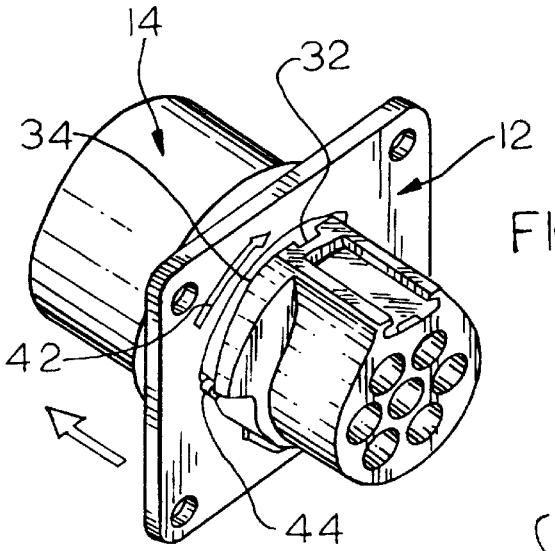
FIG. 2B
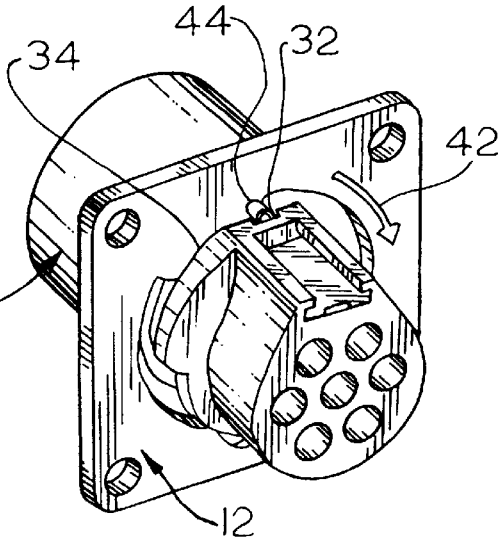
FIG. 2C

CONNECTOR WITH RELEASABLE MOUNTING FLANGE

BACKGROUND OF THE INVENTION

The present invention relates generally to a connector, and more particularly, to a connector having a mounting flange attached thereto for securing the connector to a panel.

Basically, there are two different types of electrical connectors, namely, cable connectors and flange mount connectors. Two cable connectors are interconnected directly without any mounting panel therebetween, while a flange mount connector has a flange thereon for mounting such connector in an opening of a panel, while the other mating half of the connector assembly is a cable connector that connects to the flange mount connector.

It is known in the art that a cable connector can be converted to a flange mount connector by mounting a flange on the cable connector body. However, in such prior connector, the flange is essentially permanently fixed to the connector body. The flange is pushed on the connector body over tapered projections, and then snaps behind radial shoulders on the projections, so that removal of the flange is almost impossible. Since the mounting flange cannot be removed from the connector body, the connector cannot again be converted to a cable-type connector. Furthermore, there is no seal provided in such prior connector between the flange and the connector body.

It is an object of the present invention to provide a cable connector in which a mounting flange is releasably secured to the connector body, and preferably a seal is provided between the flange and the connector body.

SUMMARY OF THE INVENTION

According to a principal aspect of the present invention, a cable connector is converted to a flange mount connector by releasably mounting a mounting flange on the connector body. The mounting flange cooperates with a resilient ring surrounding the body. The resilient ring is preferably of the type that provides sealing engagement between the flange and the body. The resilient ring forms part of a detent mechanism which provides the releasable locking and unlocking of the mounting flange on the connector body. The locking and unlocking of the flange on the body is achieved by a twisting motion of the flange relative to the body.

By the present invention, the mounting flange is fixed to the connector body in a simple and dependable manner, preferably with a seal being provided between the flange and the connector body. As will be explained later herein, the seal could be replaced by a non-sealing spring element that forms part of the detent mechanism that permits the releasable mounting of the flange on the connector body.

BRIEF DESCRIPTION OF THE DRAWINGS

FIGS. 2A, 2B, and 2C are perspective views similar to FIG. 1 showing the sequence of steps utilized to mount the mounting flange onto the connector body.

DESCRIPTION OF THE PREFERRED EMBODIMENTS

Figure 1:
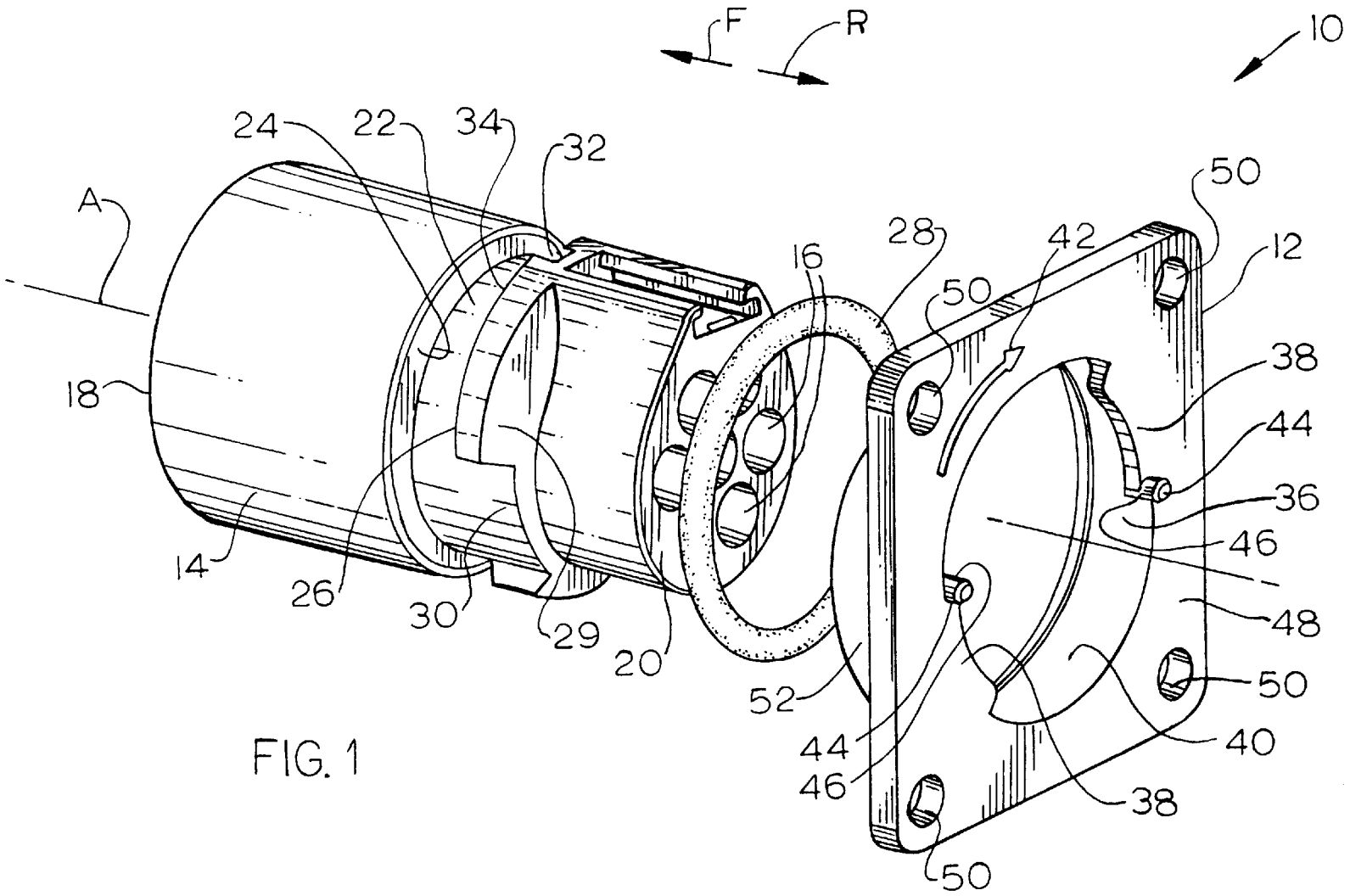
FIG. 1 is a perspective, exploded view of the connector of the present invention, with the sealing ring and mounting flange shown in a position to be installed onto the connector body.

Referring now to the drawings in detail, there is illustrated a flange mount electrical connector, generally designated 10, in which a square plastic mounting flange 12 is mounted on a generally cylindrical plastic connector body 14 of the type normally used for cable connectors. The connector body 14 is formed with a plurality of axially-extending contact passages 16 that extend from the front mating end 18 of the body to the rear 20 thereof. Electrical contacts (not shown) are mounted in the passages 16. It will be appreciated that the present invention is not limited to use with an electrical connector. The connector could also be a fiber optic connector in which case fiber optic termini would be mounted in the passages 16. Normally, the contacts are mounted in the passages 16 from the rear 20 of the connector body.

An annular groove 22 is formed in the connector body intermediate the front 18 and rear 20 of the body. The groove defines a rearwardly facing annular shoulder 24 and a forwardly facing shoulder 26. An elastomeric resilient sealing ring 28, such as a rubber O-ring, is mounted in the forward part of the groove 22 adjacent to the shoulder 24.

The connector body has an annular flange 29 in front of the groove 22. The front face of the flange forms the forwardly facing shoulder 26. A pair of diametrically opposed arcuate slots 30 are formed in the flange 29, only one of such slots being visible in FIG. 1. Locking recesses 32 are formed in the forwardly facing shoulder 26 provided by the flange 29. The recesses are spaced a predetermined circular distance from the slots 30, preferably about 90° from the center of each slot to each recess. The recesses 32 are positioned diametrically opposed to each other. Only one such recess is visible in FIG. 1.

Figure 3:
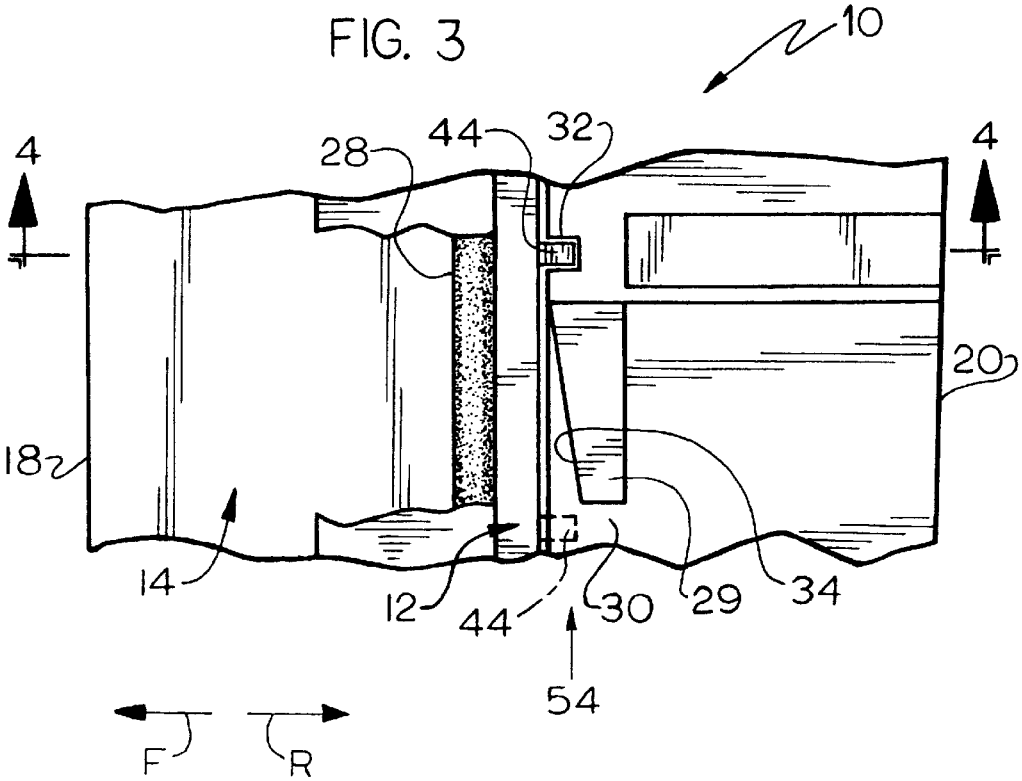
FIG. 3 is a fragmentary side view of the connector with a portion of the mounting flange broken away to show the sealing ring, and with the mounting flange mounted on the connector body in its final locked position.
Figure 5:
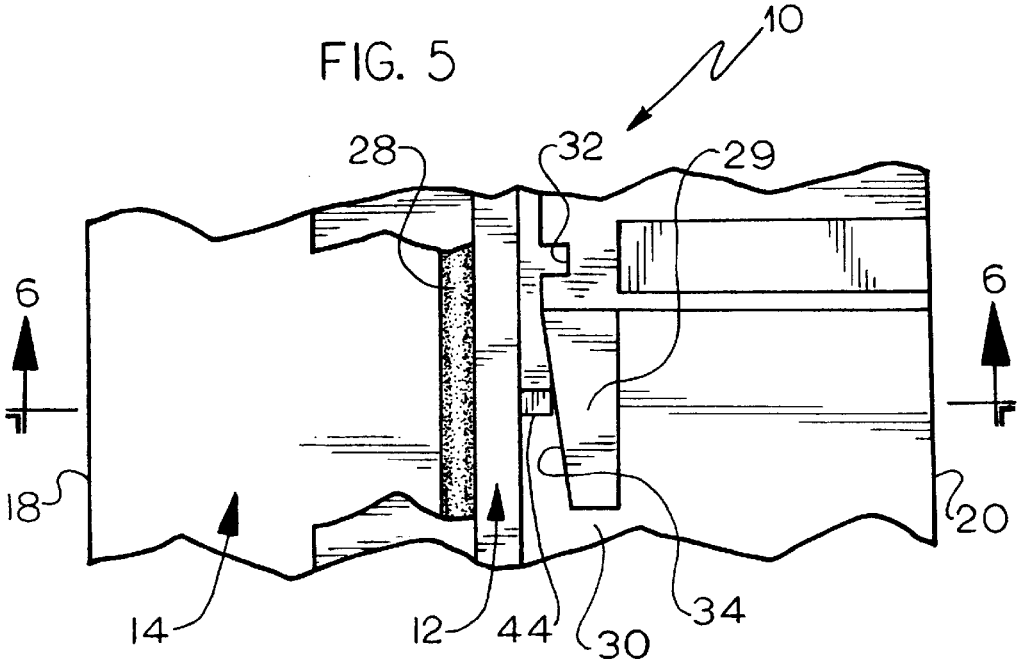
FIG. 5 is a fragmentary side view similar to FIG. 3, showing the mounting flange in an intermediate position while it is being rotated between its initial and final positions on the connector body.

As best seen in FIGS. 3 and 5, there is an angular ramp 34 on the shoulder 26 which extends rearwardly from the slot 30 to the recess 32. A like angular ramp 34 is provided between the slot and recess on the opposite side of the connector body. The purpose of the ramps and recesses will be explained later herein.

As seen in FIG. 1, the square mounting flange 12 has a central circular opening 36. The diameter of the opening is slightly greater than the diameter of the connector body 14. The mounting flange 12 embodies diametrically opposed arcuate portions or projections 38 extending inwardly from the wall 40 of the opening 36. The arcuate length of the projections 38 is slightly less than the length of the arcuate slots 30 in the connector body so that the projections can freely slide through the slots 30 when the mounting flange 12 is pushed axially onto the body.

Once the mounting flange 12 is mounted on the connector body within the groove 22, it is rotated about the longitudinal axis A of the body in the clockwise direction as viewed from the rear 20 of the connector body 14, as indicated by the arrow 42 in FIG. 1. In rotating in the direction of arrow 42, the mounting flange rotates from an unlocked position shown in FIG. 2B to a locked position shown in FIG. 2C.

Locking pins 44 are formed on the projections 38 adjacent to the leading edges 46 of the projections 38. The locking pins 44 extend rearwardly from the rear face 48 of the mounting flange 12, and they are dimensioned to fit within the recesses 32 in the connector body 14. As seen in FIG. 1, the locking pins 44 are located on the projections 38 diametrically opposed from each other.

Figure 4:
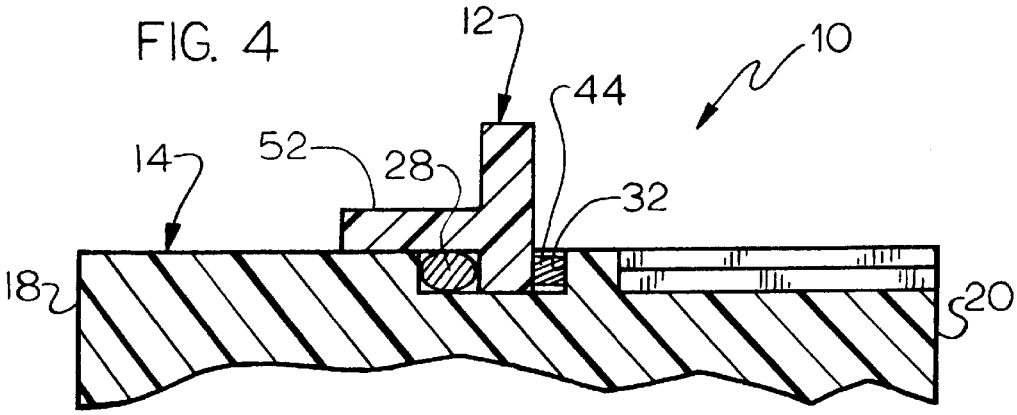
FIG. 4 is a longitudinal sectional view taken along line 4—4 of FIG. 3.

Four holes 50 are formed in the corners of the mounting flange 12 for receiving screws or other fastening elements for securing the locking flange to a panel to which the connector 10 is to be secured. The mounting flange 12 also embodies a forwardly-extending cylindrical wall 52 that surrounds the O-ring 28 when the mounting flange is mounted on the connector body 14, as seen in FIG. 4. The sealing ring 28 makes sealing engagement between the bottom of the groove 22 and the inner surface of the cylindrical wall 52 to provide an effective seal between the mounting flange 12 and the connector body.

Figure 6:
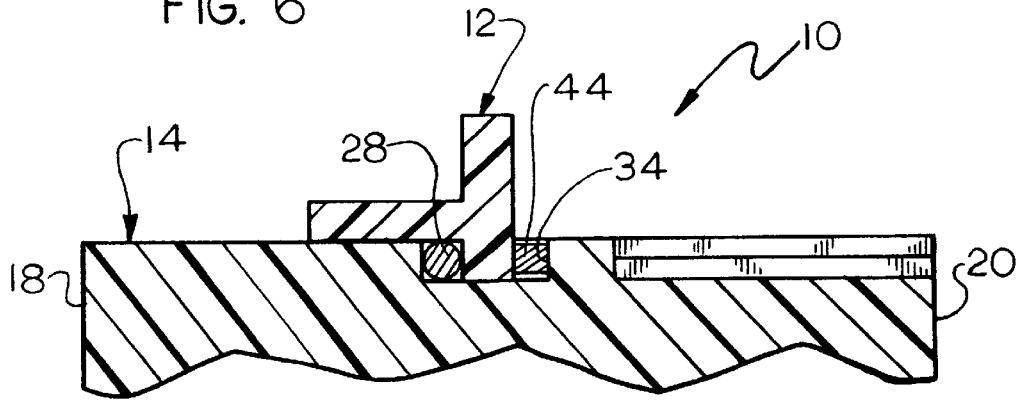
FIG. 6 is a longitudinal sectional view taken along line 6—6 of FIG. 5.

Reference is now made to FIGS. 2A, 2B, and 2C which show the sequence of steps used in mounting the mounting flange 12 on the connector body 14. Initially, the sealing ring 28 is mounted over the connector body from either the front 18 or rear 20 to position the ring in the groove 22. The sealing ring is located in the groove adjacent to the shoulder 24. The mounting flange 12 is positioned behind the connector body with the projections 38 on the flange aligned with the arcuate slots 30 in the flange 29 on the connector body. The mounting flange is then slid forwardly over the rear of the connector body until the projections 38 pass through the slots 30 and abut the sealing ring 28. At this point the mounting flange is positioned with its locking pins 44, one shown in phantom lines in FIG. 3, adjacent to the leading edge of the slot 30 in the flange 28. A slight forward pressure is then applied to the mounting flange 12, and the flange is rotated in a clockwise direction as indicated by arrow 42 in FIG. 1, causing the locking pins 44 to ride along the angular ramps 34 seen in FIGS. 5 and 6. In this position of the mounting flange, the sealing ring 28 is substantially axially compressed. Rotation of the mounting flange is continued until the flange is fully rotated 90°, whereupon the locking pins 44 will snap into the recesses 32 in the annular flange 28 under the biasing force of the compressed sealing ring, as shown in full lines in FIG. 3.

In order to remove the mounting flange 12 from the connector body 14, the flange is pressed forwardly toward the front end of the connector body, compressing the sealing ring 28 until the locking pins 44 exit from the recesses 32, whereupon the mounting flange 12 is rotated in a counterclockwise direction 90° to locate the projections 38 on the flange in alignment with the arcuate slots 30 in the connector body flange 29. The mounting flange 12 can then be readily slid off the rear of the connector body.

From the foregoing, it will be appreciated that the angular ramps 34, locking pins 44, recesses 32, and sealing ring 28 cooperate to form a detent mechanism which releasably locks the mounting flange on the connector body, and permits easy removal of the flange from the body. Thus, the sealing ring 28 serves two functions, namely, as part of the detent mechanism, and also seals the mounting flange 12 to the connector body 14. Hence, the connector body 14 may be used as a cable connector, or may be modified to have the mounting flange 12 releasably mounted thereon to convert the cable connector to a flange mount connector for mounting to a panel.

While the connector described herein employs an elastomeric sealing ring, it will be appreciated that if a sealing function between the mounting flange 12 and connector body 14 is not necessary for a particular application of the connector, the sealing ring 28 could be replaced by any form of spring, such as an annular split wave washer that would be mounted in the groove 22 adjacent to the shoulder 24. Also, the locking pins could be mounted on the annular flange 29 of the connector body extending in a forward direction, and the angular ramps 34 and pin-receiving recesses 32 could be formed in the rear surface of the mounting flange 12. Further, while the mounting flange has been described as being formed of plastic, it could also be formed of metal, and the plastic connector body 14 could be replaced by a metal connector shell containing an insulator in which the contact passages 16 are formed. C-CCD-0183 Although a number of embodiments of the invention have been described and illustrated herein, it is recognized that additional modifications and variations to the invention may readily occur to those skilled in the art and, consequently, it is intended that the claims be interpreted to cover such modifications and equivalents.

What is claimed is:

1. A connector comprising:

a generally cylindrical connector body having a longitudinal axis and adapted to contain at least one contact, said body having an annular groove therein defining opposed first and second shoulders;

a resilient sealing ring surrounding said body and mounted in said groove adjacent to said first shoulder;

a mounting flange axially mounted on said body in sealing engagement with said sealing ring;

said mounting flange being rotatable about said axis between an unlocked position and a locked position, and said mounting flange having an inwardly-extending portion mounted in said groove between said sealing ring and said second shoulder;

a detent mechanism including said sealing ring releasably locking said mounting flange in said locked position, said detent mechanism including a locking pin mounted on said inwardly-extending portion and a matching pin-receiving recess formed in said second shoulder.

2. A connector as set forth in claim 1 wherein:

said body has opposite ends, an arcuate slot in said body extends from said groove toward one end of said body for axially slidably receiving said inwardly-extending portion there through when said mounting flange is axially mounted on said body from said one end.

3. A connector as set forth in claim 2 wherein:

said second shoulder faces in a direction opposite to said one end of said body;

said recess is formed in said second shoulder spaced a predetermined circular distance in one direction from said slot;

said locking pin extends toward said one end of said body;

an angular ramp extends from said slot to said recess over which said pin rides when said mounting flange is rotated toward said locked position; and said sealing ring is axially compressed when said mounting flange is rotated in toward said locked position, said sealing ring urging said locking pin into said recess when said mounting flange is rotated to said locked position.

4. A connector comprising:

a generally cylindrical connector body having a longitudinal axis and adapted to contain at least one contact, said body having axially spaced first and second shoulders;

a resilient sealing ring surrounding said body and lying between said shoulders;

a mounting flange axially mounted on said body and rotatable about said axis between unlocked and locked positions, said mounting flange having an inwardly-extending portion lying between said sealing ring and said second shoulder in said locked position;

said second shoulder and said mounting flange having respective second (32)and first (44) axially extending parts positioned so said second part lies in the path of said first part when said mounting flange is in said locked position and turns away from said locked position, with said first part moved axially out of a position to engage said second part when said sealing ring is compressed, to thereby keep said parts engaged until said mounting flange is pushed axially to compress said sealing ring and said mounting flange is turned while said sealing ring is compressed.

5. A connector as set forth in claim 4:

said mounting flange has a locking pin and said second shoulder has walls forming a recess that receives said locking pin, with said locking pin and recess walls forming said axially-extending parts.

6. A connector as set forth in claim 5 wherein:

said second shoulder forms an angular ramp that extends to said recess and over which said pin rides when said mounting flange is rotated to said predetermined position.

7. A connector comprising:

a generally cylindrical body having a longitudinal axis and adapted to contain at least one contact, said body having a pair of axially-spaced shoulders;

a resilient sealing ring surrounding said body and lying against a first of said shoulders;

a mounting flange mounted on said body and being rotatable about said axis between an unlocked position and a locked position, with said flange trapped between said sealing ring and said second shoulder and axially compressing said sealing ring in said locked position;

said mounting flange has a cylindrical wall with a radially inner surface that presses radially inward against said sealing ring in said locked position, and that compresses said sealing ring radially inwardly against said body.

* * * * *